US005140335A

United States Patent [19]

Staehlin et al.

[11] Patent Number: 5,140,335

[45] Date of Patent: Aug. 18, 1992

[54] BACK-TO-BACK RIDGED BRANCH MANIFOLD STRUCTURE FOR A RADAR FREQUENCY ANTENNA

[75] Inventors: John H. Staehlin, Lutherville; Lanson Y. Shum, Highland; David W. Parry, Ellicott City; Frank B. Gabranski, Linthicum; Douglas K. Comstock, Glen Burnie; Albert F. Zirkle, Columbia; Richard S. Konapelsky, Columbia; Michael A. Mongilio, Columbia, all of Md.

[73] Assignee: Westinghouse Electric Corp., Pittsburgh, Pa.

[21] Appl. No.: 603,345

[22] Filed: Oct. 26, 1990

[51] Int. Cl.[5] ..... H01Q 3/36; H01P 5/18

[52] U.S. Cl. ..... 343/778; 343/853; 333/114; 333/137

[58] Field of Search ..... 333/114, 125, 137; 343/777, 778, 853

[56] References Cited

U.S. PATENT DOCUMENTS

| | | | |
|---|---|---|---|
| H,392 | 12/1987 | Staehlin | 333/114 |
| 2,951,997 | 9/1960 | Stone | 333/114 |
| 3,434,139 | 3/1969 | Algeo | 343/778 |
| 3,518,576 | 6/1970 | Algeo | 333/114 |
| 3,518,689 | 6/1970 | Algeo et al. | 343/778 |
| 3,906,502 | 9/1975 | Connolly | 343/853 X |
| 4,952,894 | 8/1990 | Connerney et al. | 333/114 X |

*Primary Examiner*—Eugene R. LaRoche
*Assistant Examiner*—Benny T. Lee
*Attorney, Agent, or Firm*—T. H. Martin

[57] ABSTRACT

RF manifolding for a radar antenna which allows tight spacing of Phase Control Modules (PCMs) is disclosed. The manifolding consists of ridged branch manifold waveguides to which ridged cross waveguide sections are installed. Each branch manifold waveguide of the present invention has ridges on one broad wall, coupling slots on another broad wall, and a plurality of cross waveguides connected on the side having the coupling slots. The cross waveguides are likewise provided with ridges on one broad wall, which are oriented at right angles to the ridges of the branch manifold waveguide, and have coupling slots on the opposite broad wall which correspond to the coupling slots of the branch manifold waveguide. The PCMs are mounted on the end of each cross waveguide, parallel to the ridges thereof. The branch manifold waveguide assemblies, comprising the branch manifold waveguides, the cross waveguides, and the PCMs, are installed on the antenna in parts and oriented back-to-back, with their ridges contacting to enclose a space defined by the walls of the two branch manifolds. The space enclosed between the branch manifold waveguides of the assembled pair by virtue of these ridges may be used for fluid cooling in high power antenna applications.

10 Claims, 2 Drawing Sheets

BACK-TO-BACK RIDGED BRANCH MANIFOLD STRUCTURE FOR A RADAR FREQUENCY ANTENNA

BACKGROUND OF THE INVENTION

The present invention generally relates to the field of electronic scan phased-array radar antennas, such as might be used in airborne ground-mapping systems and is specifically concerned with a manifold structure capable of accommodating a high density of phase control modules in such antennas.

A typical electronic scan radar antenna is constructed on an elliptical aluminum plate about two feet by four feet in dimension. Several hundred holes are drilled in the plate at predetermined intervals, and several hundred phase control modules (PCMs) are mounted so that one PCM protrudes from each hole. The PCM devices can be controlled to transmit and receive RF signals in a desired pattern so that the antenna can scan a selected geographical area without the need for moving parts.

FIG. 1 illustrates the prior art structure by which the PCMs 105 are coupled to the system's RF transmitting and receiving equipment using RF waveguides known as manifolds. In the prior art, such antennas have used a waveguide branch manifold structure in which RF signals are carried through a plurality of rectangular main manifold feeds (not shown) which are connected to branch manifolds 101 by a coupling flange. The signals are transmitted through the branch manifold 101 and through cross waveguides 104 to the PCMs 105. The cross waveguides 104 are attached to the branch manifolds 101 and spaced according to the desired PCM spacing, which will determine the characteristics of the antenna. The branch manifolds 101 are usually deployed in parallel, horizontally across the antenna, to connect the PCMs 105 and are also connected (according to the quadrant of the antenna they are located in) to one of four main manifold feeds (not shown in FIG. 1) which are connected to the transmitter and receiver. The manifold feeds are deployed vertically. A load is provided to absorb excess signals at the end of each branch manifold 101 and cross waveguide 104.

This prior art design functions well in antennas where closely spaced PCMs 105 are not required. However, as the technology of phased array antennas progresses, so that smaller antennas with better RF performance and higher power handling capability are desired and developed, tight spacing of PCMs 105 is becoming an important requirement. Rectangular waveguides which are able to carry the desired signal frequencies and power levels may have a cross-sectional width "A" larger than the desired PCM spacing "B". Constructing an antenna with horizontal main manifolds and a PCM spacing "B" of less than the required width "A" of the cross waveguides 104 is physically impossible, because a plurality of cross waveguides 104 would have to share the same physical space.

It is known to orient the branch manifolds diagonally rather than horizontally, but this method has not been completely satisfactory. With diagonal branch manifolds, the attachment of the quadrant manifolds to the branch in the manifold assemblies becomes quite complex. This technique, known as quadranting the antenna array, is desirable to improve signal processing capabilities.

An additional problem arises as the power to be transmitted by phased array radars increases. At high power levels, the manifold waveguide structure will become quite hot. Therefore, for high power systems, cooling may be desired. However, many tightly constructed prior art systems have no provision for either air or liquid cooling of the manifold waveguide structure.

Therefore, there is a need for an improved antenna manifold assembly that allows close PCM spacing while maintaining a horizontal and vertical (nondiagonal) manifold structure which permits quadranting of the antenna array. In addition, there is a need for antenna manifold assemblies that are adapted for fluid cooling so that high power levels can be used.

SUMMARY OF THE INVENTION

Thus, it is a broad object of the present invention to provide a novel and improved antenna manifolding system.

A more specific object of the present invention is to provide a novel and improved antenna manifolding structure which allows close spacing of phase control modules associated with the antenna manifolding.

Another object of the present invention is to provide a novel and improved antenna manifolding structure which facilitates fluid cooling of the antenna system.

Yet another object of the present invention is to provide a novel and improved antenna manifolding structure which allow close spacing of phase control modulators associated with the antenna manifolding, while maintaining a horizontal and vertical orientation of the manifolds relative to the phase control modulator pattern.

A further object of the present invention is to provide a novel and improved antenna manifolding structure which uses ridged branch and cross waveguides to achieve reduced manifold size and improved efficiency.

These objects and others which will become obvious after reference to the specification and drawings are accomplished by providing novel and improved RF manifolding for tightly spaced PCMs, consisting of ridged manifold waveguides to which ridged cross waveguide sections are installed, thus providing exceptionally closely spaced cross waveguides for manifolding that is oriented vertically or horizontally in an antenna.

Each branch manifold waveguide of the present invention has ridges on one broad wall, coupling slots on another broad wall, and a plurality of cross waveguides connected on the side having the coupling slots. The cross waveguides are provided with ridges on one broad wall, oriented at right angles to the ridges of the branch manifold waveguide, and have coupling slots on the opposite broad wall which correspond to the coupling slots of the branch manifold waveguide. The PCMs are mounted on the end of the cross waveguides, parallel to the ridges thereof.

The manifold waveguide assemblies, comprising the branch manifold waveguides, the cross waveguides, and the PCMs, are installed on the antenna in pairs and oriented back-to-back, with their ridges contacting to enclose a space defined by the walls of the two branch manifolds. The space enclosed between the branch manifold waveguides of the assembled pair by virtue of these ridges may be used for fluid cooling in high power antenna applications.

DETAILED DESCRIPTION OF A PREFERRED EMBODIMENT

Figure 2:
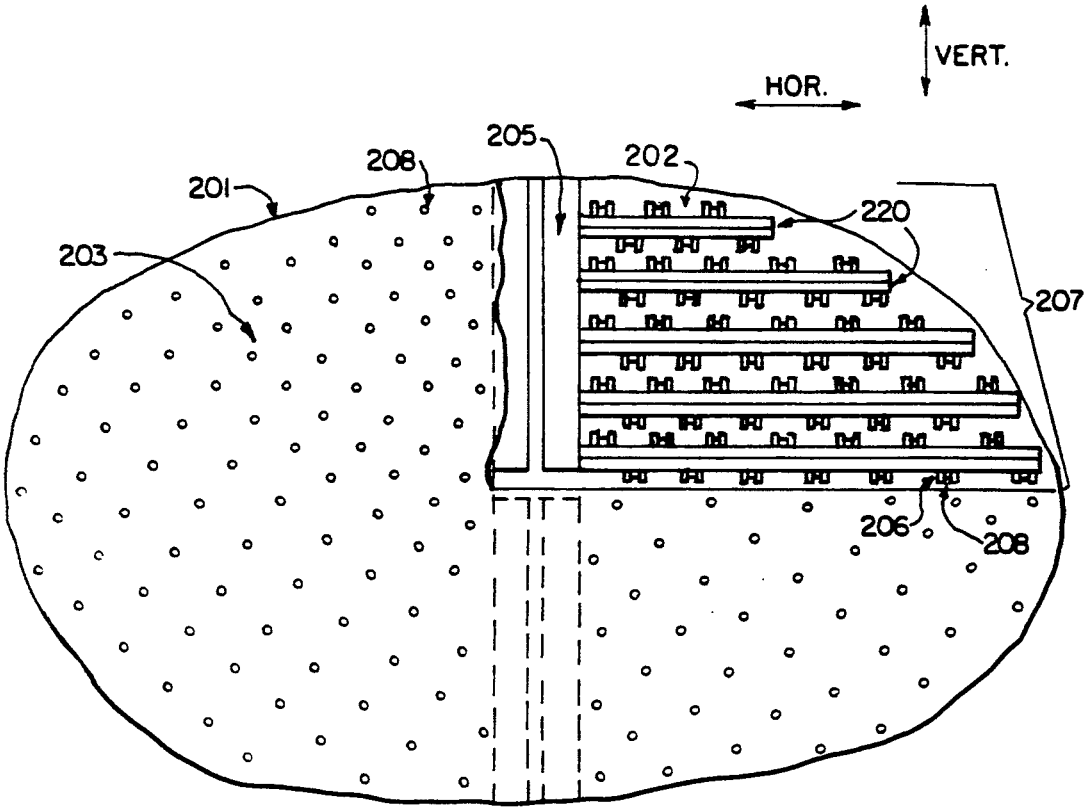
FIG. 2 is a sectional assembly drawing of an antenna constructed with the branch manifold waveguide assemblies of the present invention.

Referring first to FIG. 2, the manifold waveguide structure of the present invention is designed for use with an electronic scan, phased array radar antenna 201. This antenna may be constructed on an elliptical aluminum plate 203 about two feet by four feet in dimension. Several hundred holes are drilled in the plate at predetermined intervals, and several hundred phase control modules (PCMs) 208, also known as protrudes from each hole. The PCMs 208 can be controlled to transmit and receive RF signals in a desired pattern so that no moving parts are required in the antenna 201.

The antenna 201 is preferably provided with four rectangular main manifold feeds 205, one for each quadrant 207 of the antenna 201, i.e. upper left, lower left, upper right, and lower right. To form the antenna 201, a plurality of mated branch manifold pairs 220, each comprising two ridged branch manifold assemblies 202, will be attached to each main manifold feed 205 to form a quadrant 207 of the antenna 201. The main manifold feeds 205 are disposed vertically, and the mated branch manifold pairs 220 are mounted perpendicular to the main manifold feeds 205 so as to be horizontal. Of course, it is not necessary that the main manifold feeds 205 and the attached mated branch manifold pairs 220 lie in the same plane, but it is desirable that, in general, lines parallel to the longitudinal axes of main manifold feeds 205 be perpendicular to lines that are parallel to the longitudinal axes of mated branch manifold pairs 220.

Figure 3:
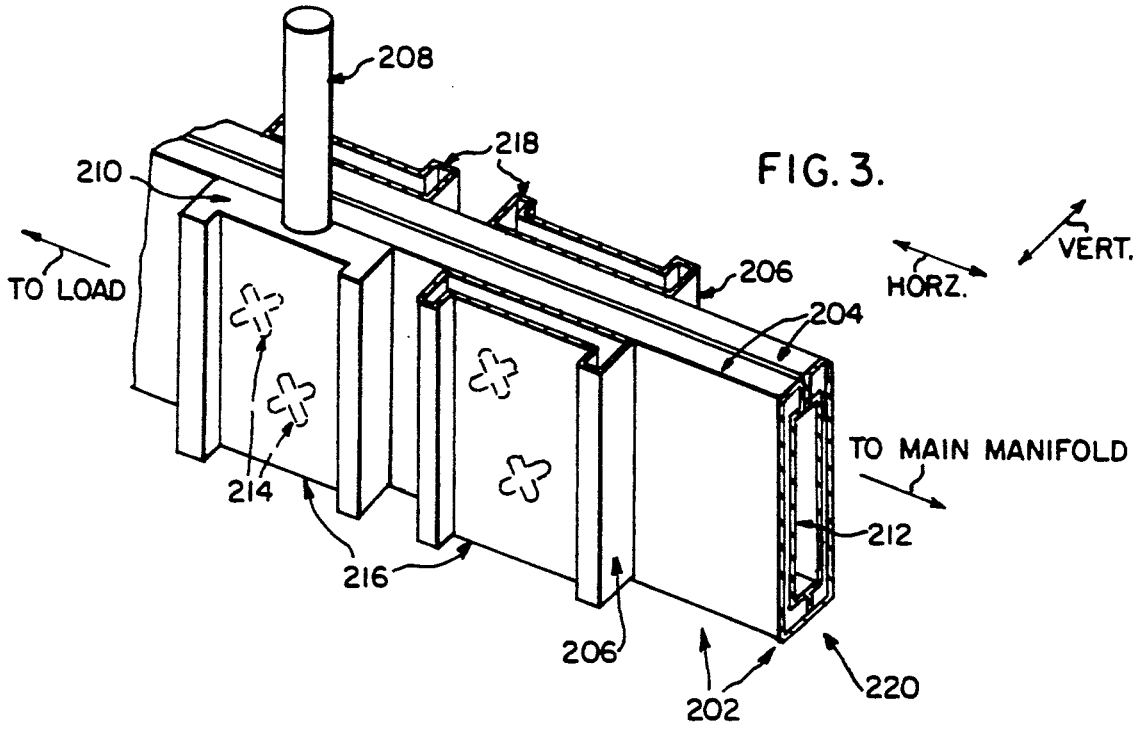
FIG. 3 is an assembly drawing showing a portion of a branch manifold waveguide assembly according to the present invention.

Referring now to FIG. 3, a portion of two branch manifold assemblies making up a branch manifold pair 220 is shown at 202. Each branch manifold assembly 202 comprises a ridged branch manifold waveguide 204, also known as the primary manifold waveguide, a plurality of ridged cross waveguides 206, also known as the secondary manifold waveguide, and PCMs 208 equal in number to the ridged cross waveguides 206 and mounted thereto by one each of the adapter flanges 210.

The term "ridged," when applied to the ridged waveguides 206 as shown in FIG. 3, is meant to indicate that the waveguides are not rectangular. In the preferred embodiment of "ridged" shown in FIG. 4, the ridged waveguides have a cross section generally in the shape of an elongated "C". That is, the enclosed cross sectional area of the ridged waveguides includes a main, elongated rectangular area 302, and two additional, smaller rectangular regions 304 disposed at the extreme opposite ends but protruding from the same side of the main area and at right angles thereto. The smaller rectangular regions 304 produce ridges 306 on the waveguide. The ridged waveguides thus have a flat side 308 and a ridged side 310. The dimensions of the areas 302 and 304 in each waveguide will depend on the desired bandwidth, operating frequency, and power handling characteristics of the antenna 201. Dimensions appropriate to the desired parameters may be calculated by well known methods which are given, for example, in "The Cutoff Wavelength of the TE10 Mode in Ridged Rectangular Waveguides of any Aspect Ratio," by J. R. Pyle as published in IEEE Transactions on Microwave Theory and Technique, April 1966. Other appropriate non-rectangular structures could also be used within the scope of the present invention.

Figure 4:
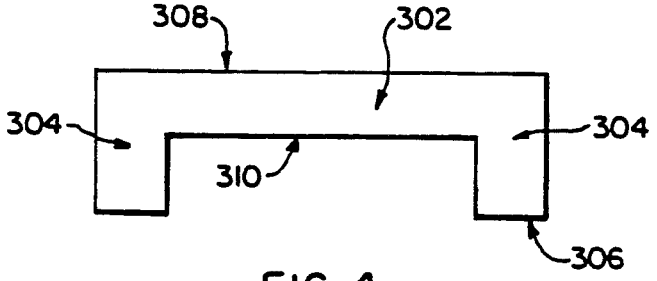
FIG. 4 is a cross sectional view of a ridged waveguide used in the present invention.

Referring again to FIG. 3, the ridged branch manifold waveguides 204 are formed with two parallel ridges and thus have a C-shaped cross section as described with reference to FIG. 4. As noted previously, each ridged branch manifold waveguide 204 is preferably disposed horizontally on the antenna 201. The terms vertical and horizontal are used herein to describe the manifold structure and refer to the structure when the antenna 201 is in a fixed position with the length of each of the PCMs 208 parallel to the plane of the earth's surface, i.e. the orientation of FIG. 3. It will be understood that these terms relate only to this theoretical position of the antenna and that in actual use, the antenna 201 may be pointed in ay direction so that its components will not in use be disposed vertically and horizontally.

The ridged branch manifold waveguides 204 are installed in mated branch manifold pairs 220, with their ridged sides facing with ridges abutting so that a closed cooling tunnel 212 is defined between the ridge sides and ridges of the pair of ridged branch manifold waveguides 204. At one end of the pair of ridged branch manifold waveguides 204 (on the right side in FIG. 3), the pair of ridged branch manifold waveguides 204 will be connected to an appropriate one of the four main manifolds feeds 205 of the antenna 201, depending on the quadrant location of the branch manifold assembly 202 in the antenna 201. An appropriate coupling flange (not shown in FIG. 3) will preferably be provided at the end of ridged branch manifold waveguides 204 to facilitate this connection.

In the wall of the flat side of the ridged branch manifold waveguides 204 (the flat side being opposite from the ridged side), there are formed coupling slots 214. There are preferably two coupling slots provided at each location where a slotted cross waveguide 206 is to be mounted. The coupling slots are formed with a large length-to-width ratio. The precise dimensions, number, and location of these coupling slots 214 can be varied depending on the frequencies used, the power level, and the desired level of signal transmission to each PCM 208.

At the opposite end of ridged branch manifold waveguides 204 from the connection to the main manifold, at the left end in FIG. 3, a load (not shown) will be provided to absorb any excess energy which is not transmitted to the PCMs 208.

The cooling tunnel 212 may be used for fluid cooling of the branch manifold assemblies 202. The fluid used may be air, another gas, or any of a number of liquids with appropriate heat transfer and physical characteristics. The fluid used will be fed by an appropriate pumping means such as a fan or liquid pump. If a gas such as air is used for cooling in the cooling tunnels 212, the air could be blown through the cooling tunnels 212 in the antenna 201 by a fan situated to feed either end of each cooling tunnel 212, including the main manifold end and the load end. At the other end, a vent would be provided to permit the flow of the gas through the cooling tunnel 212. If a liquid coolant is to be used, cooling tubes could be attached within the cooling tunnel 212 in any desired configuration. These cooling tubes might enter and exit the cooling tunnels 212 at a single end of the cooling tunnels 212 (i.e. the load end or the main manifold end) or might enter at one end and exit at the other end. Alternatively, the cooling tunnel 212 itself could easily be made liquid-tight and cooling fluid could be pumped directly through each cooling tunnel 212 in the antenna.

The ridged cross waveguides 206 have a C-shaped cross section as described previously with reference to FIG. 4 Ridged cross waveguides 206 are mounted on the flat (non-ridged) side of each ridged branch manifold waveguide 204 with the flat side of the ridged cross waveguides 206 fixed to the ridged branch manifold waveguide 204 and the ridges of the ridged cross waveguides 206 perpendicular to the ridges of the ridged branch manifold waveguide 204. The bottom ends 216 of the ridged cross waveguides are closed and terminates with a load, while the upper ends 218 of the ridged cross waveguides 206 are open to receive a PCM 208 which is mounted to the upper end 218 of each ridged cross waveguide 206 by means of an adapter flange 210 which is shaped appropriately to channel signals between each PCM 208 and the antenna electronics.

The ridged cross waveguides 206 have coupling slots 214 in their flat sides which are constructed and located to align with the coupling slots 214 in the ridged branch manifold waveguide 204. Thus, there is an RF signal transfer path from the antenna electronics (not shown), to the four main manifold feeds 205, through the ridged branch manifold waveguides 204 connected to each main manifold feed 205, through the ridged cross waveguides 206, to the PCMs 208 for transmission and in reverse of the path just described for reception.

The ridged cross waveguides 206 are spaced along the flat side of each ridged branch manifold waveguide 204 according to the spacing desired for PCMs 208. The ridged cross waveguides 206 on a single pair of ridged branch manifold assemblies 202 may be placed directly across from each other on opposite sides of the mated pair of ridged branch manifold waveguides 204, as shown in FIG. 3, so that the ridged branch manifold assemblies 202 form a mirror image of one another. Alternatively, the ridged cross waveguides 206 may be placed other than directly across from each other, so that the row of ridged cross waveguides 206 on each ridged branch manifold assembly 202 in the pair is offset with respect to the opposite ridged cross waveguides 206, similar to the arrangement shown in FIG. 2.

Figure 1:
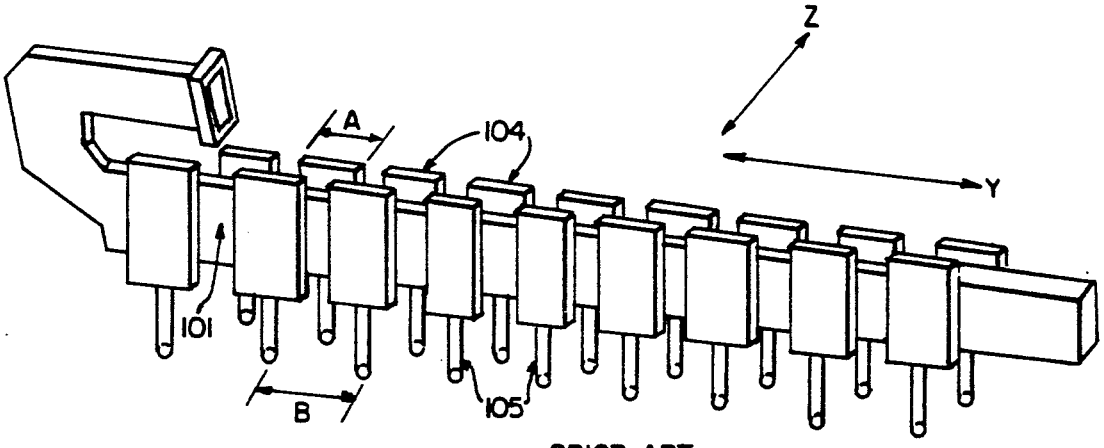
PRIOR ART FIG. 1.
FIG. 1 is an assembly drawing showing a branch manifold waveguide assembly according to the prior art.

It should be noted that significant flexibility in placement of the ridged cross waveguides 206, and thus the PCMs 208, is obtained by virtue of the ridged design of the ridged cross waveguides 206. The ridges in the ridged cross waveguides 206 should be dimensioned to create a waveguide whose electrical width is above cutoff for the frequencies being transmitted and received by the antenna 201. Yet, the physical width of the ridged cross waveguides 206 will be less than the width required for conventional rectangular cross waveguides as shown in FIG. 1. Therefore, much closer spacing of PCMs 208 is possible and spacing patterns may be formed with the ridged cross waveguides 206 which were not possible with conventional rectangular cross waveguides. Further, because of the close spacing of PCMs 208 that can be accomplished with the manifold structures disclosed, the ridged branch manifold waveguides 204 can be arranged horizontally on the antenna, and the main manifold feeds can therefore be arranged vertically, while still maintaining the desired spacing of PCMs 208.

STATEMENT OF INDUSTRIAL APPLICABILITY

The present invention is an RF manifold structure which will find its primary application in a phased array antenna system.

I claim:

1. A manifold structure for a phased array antenna having at least one main manifold feed, comprising:

a plurality of phased shifting means for transmitting and receiving signals;

a plurality of secondary manifold waveguide means, each secondary manifold waveguide means interfaced to a respective phase shifting means, for carrying said signals to and receiving said signals from the phase shifting means, said secondary manifold waveguide means each having a flat side and an opposite ridged side waveguide structure; and a plurality of primary manifold waveguide means, each primary manifold waveguide means slot coupled to said flat side of said plurality of secondary manifold waveguide means and interfaced to respective ones of the antenna's main manifold feeds, for carrying said signals between the secondary manifold waveguide means and the interfaced main manifold feed.

2. The structure of claim 1 wherein each primary manifold waveguide means is a ridged waveguide.

3. The structure of claim 1 wherein each primary manifold waveguide means is oriented perpendicular to the respectively interconnected main manifold feed.

4. A manifold structure for a phased array antenna having at least one main manifold feed, comprising:

a plurality of phased shifting means for transmitting and receiving signals;

a plurality of secondary manifold waveguide means, each secondary manifold waveguide means interfaced to a respective phase shifting means, for carrying said signals to and receiving said signals from the phase shifting means, said secondary manifold waveguide means each having a flat side and an opposite ridged side waveguide structure; and a plurality of pairs of primary manifold waveguide means, each primary manifold waveguide means having a flat side and an opposite ridged side waveguide structure, said flat side of each primary manifold waveguide means being slot coupled to said flat side of said plurality of secondary manifold waveguide means and interfaced to respective ones of the antenna's main manifold feeds, for carrying said signals between the secondary manifold waveguide means and the interfaced main manifold feed;

wherein the ridges of the primary manifold waveguide means in each pair abut to define a respective passage between each pair of primary manifold waveguide means.

5. The structure of claim 4 for use in an antenna wherein the at least one main manifold feeds are parallel to one another, wherein each primary manifold waveguide means is oriented perpendicular to the respectively interconnected main manifold feed.

6. A manifold structure for a phased array antenna having at least one main manifold feed, comprising:

a plurality of phased shifting means for transmitting and receiving signals;

a plurality of secondary manifold waveguide means each having a flat side and an opposite ridged side waveguide structure, each secondary manifold waveguide means interfaced to a respective phase shifting means, for carrying said signals to and receiving said signals from the phase shifting means; and a plurality of pairs of primary manifold waveguide means, each primary manifold waveguide means having a flat side and an opposite ridged side waveguide structure, said flat side of each primary manifold waveguide means being slot coupled to said flat side of said plurality of secondary manifold waveguide means and interfaced to respective ones of the antenna's main manifold feeds, for carrying said signals between the secondary manifold waveguide means and the interfaced main manifold feed;

wherein the ridges of the primary manifold waveguide means in each pair abut to define a respective passage between each pair of primary manifold waveguide means;

wherein each passage carries cooling fluid through the structure.

7. The structure of claim 6 wherein each passage contains respective cooling fluid carrying means for carrying cooling fluid through the structure.

8. The structure of claim 7 wherein the respective cooling fluid carrying means includes at least one cooling tube for carrying cooling fluid.

9. The structure of claim 6 wherein each passage is itself a cooling fluid channel having one end and an opposite end, said cooling fluid channel having a fluid inlet at the one end and a fluid outlet at the opposite end.

10. A manifold structure for a phased array antenna of the type including phase shifting means and having a plurality of main manifold feeds, comprising:

a plurality of secondary manifold waveguide means, each secondary manifold waveguide means interfaced to a respective phase shifting means, for carrying a signal to and receiving a signal from the antenna phase shifting means, said secondary manifold waveguide means each having a flat side and an opposite ridged side waveguide structure; and a plurality of pairs of primary manifold waveguide means, each primary manifold waveguide means having a flat side and an opposite ridged side waveguide structure, said flat side of each primary manifold waveguide means slot coupled to said flat side of said plurality of secondary manifold waveguide means and interfaced to respective ones of the antenna's main manifold feeds for carrying and receiving said signals between the secondary manifold waveguide means and the interfaced main manifold feed;

wherein the ridges of the primary manifold waveguide means in each pair abut to define a respective passage between each pair of primary manifold waveguide means.

* * * * *